United States Patent [19]

Loy et al.

[11] 4,310,187

[45] Jan. 12, 1982

[54] DOOR SECURING MECHANISM

[75] Inventors: Jeffrey A. Loy, Newville, Pa.; Albert H. Goetsch, Clinton, Wis.; John W. Lahman, West Chester, Pa.

[73] Assignee: Sundstrand Corporation, Rockford, Ill.

[21] Appl. No.: 94,343

[22] Filed: Nov. 14, 1979

[51] Int. Cl.[3] ..... E05C 9/16

[52] U.S. Cl. ..... 292/56; 292/111; 292/260

[58] Field of Search ..... 292/26, 30, 48, 49, 292/53, 55, 56, 192, 214, 215, 256.67, 111, 260

[56] References Cited

U.S. PATENT DOCUMENTS

| | | | |
|---|---|---|---|
| 969,776 | 9/1910 | Foley | 292/55 X |
| 1,120,095 | 12/1914 | Shook | 292/214 |
| 1,197,560 | 9/1916 | Smith | 292/26 |
| 1,321,341 | 11/1919 | Troyer . | |
| 1,429,116 | 9/1922 | Taylor . | |
| 1,871,834 | 8/1932 | Astrom | 292/256.67 X |
| 1,902,547 | 3/1933 | Endter | 292/214 |
| 2,113,573 | 4/1938 | Collison | 268/74 |
| 2,295,324 | 9/1942 | Arthur | 292/48 |
| 3,669,481 | 6/1972 | Bergmann | 292/53 |

FOREIGN PATENT DOCUMENTS

| | | | |
|---|---|---|---|
| 589955 | 3/1959 | Italy | 292/49 |

*Primary Examiner*—Richard E. Moore

*Attorney, Agent, or Firm*—Wegner, Stellman, McCord, Wood & Dalton

[57] ABSTRACT

A mechanism for securing a door to a door frame includes a plurality of generally C-shaped clamps rotatably secured about the door's periphery, each of the clamps including a rear radial clamp leg engageable with the rear of the door frame, a forward radial clamp leg overlying the front surface of the door, and a connecting base extending between the radial legs, with inner cam surfaces on each radial leg and an outer cam surface on the forward radial leg. A plurality of wedges are slidably secured to the door front surface for radial movement between extended and retracted positions wherein the wedge respectively engages or does not engage the inner cam surface on an associated forward clamp leg to effect latching or unlatching of each clamp about the door and frame. Each wedge includes a cam block carried by an arm overlying an associated clamp and spaced radially outwardly of the wedge cam surface to engage said outer cam surface of the associated forward clamp leg to move the rear clamp leg from the door frame as the wedge is moved to its retracted position.

15 Claims, 7 Drawing Figures

DOOR SECURING MECHANISM

BACKGROUND OF THE INVENTION

This invention relates to a door securing mechanism and, more specifically, to a door securing mechanism actuatable from a remote station.

It is necessary in various applications to securely retain a door against its frame in such a way that forces tending to open the door do not tend to open or release the securing mechanism. Additionally, many applications require that the door securing mechanism be capable of actuation from a remote station.

Typical of such an application is a door located at the boundary of a nuclear reactor containment pool which seals the containment pool from a fuel transfer tunnel leading from the containment pool to a spent fuel storage pool. The storage pool is usually in a building separate from the containment pool and may have a second door at its boundary to isolate the storage pool from the tunnel.

The doors at either end of the fuel transfer tunnel provide a means of positively isolating the reactor containment pool from the spent fuel storage pool during operation of the reactor, and allow access to the tunnel during refueling operations. It is necessary that the integrity of the seals at the tunnel ends be capable of testing during reactor operation.

The doors are typically located substantially below the water level of each of the respective pools and must be capable of remote actuation with minimal effort, and should require only minimal maintenance. Further, the doors must be secure during seismic disturbances as well as during normal operation.

SUMMARY OF THE INVENTION

According to the present invention, a door securing mechanism is provided which is not released by forces tending to open the door.

Specifically, a door securing mechanism is provided which is actuated and deactuated by the application of forces directed radially of the door, and which remains tightly locked against forces acting directly against the door.

Further, the door securing mechanism of the invention requires minimum actuation effort, is suitable for use on doors which seat upon compression seals, and is adaptable for in-service seal testing.

According to the present invention, a plurality of clamps are rotatably mounted about the periphery of a door to capture the door to its associated frame when the door is in a closed position, and are movable in directions normal to the door by radially movable wedges to tightly retain the door against the frame.

The wedges are movable in response to rotation of a center plate to which the wedges are linked. Rotation of the center plate is effected by remote actuation.

Other objects and advantages of the invention will be apparent from the following detailed description with reference to the drawings and the appended claims.

DETAILED DESCRIPTION OF PREFERRED EMBODIMENT

Figure 2:
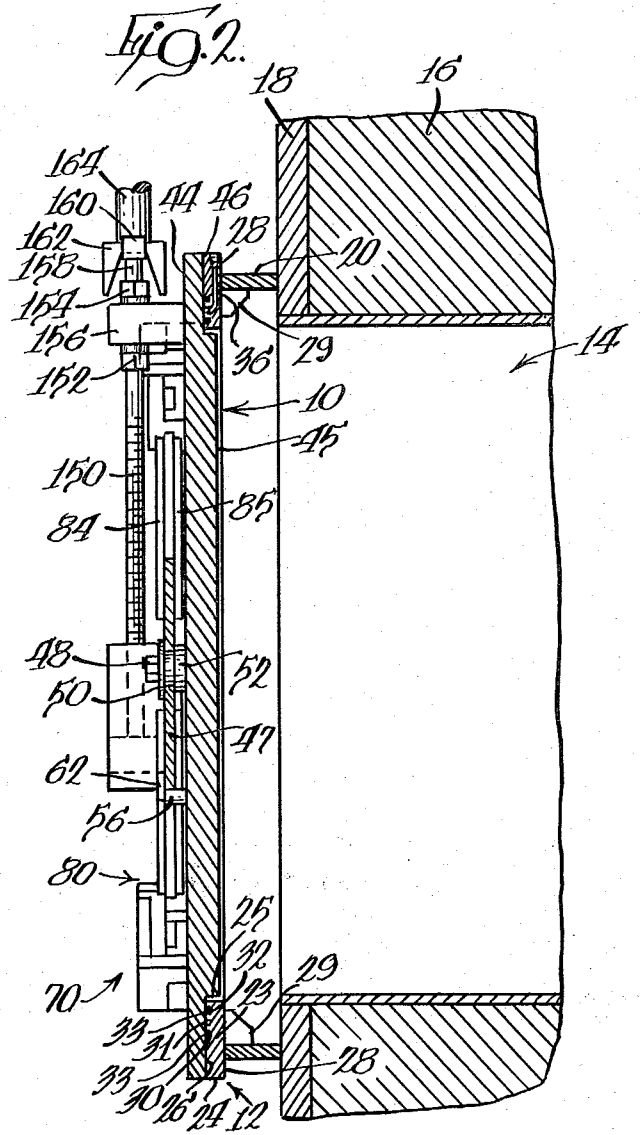
FIG. 2 is a vertical section of the door and frame of FIG. 1 taken approximately along line 2—2 of FIG. 1.
Figure 1:
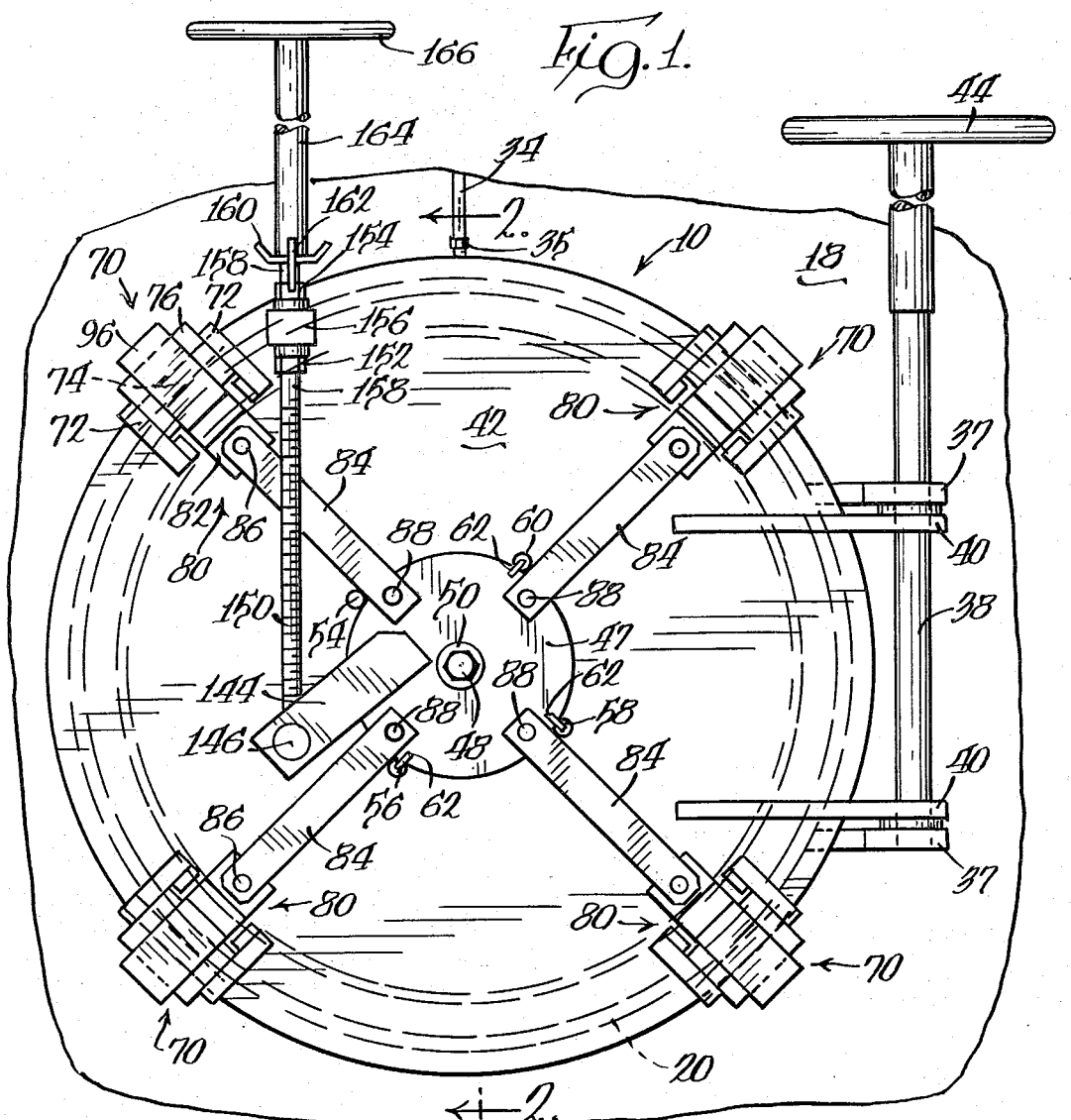
FIG. 1 is an elevation of a door and frame with a door securing mechanism according the the invention, with the door shown in its closed position and the door securing mechanism shown in its fully latched position.

Referring to FIGS. 1 and 2, a door securing mechanism according to the present invention is illustrated in place upon a door associated with a door frame, generally designated 10 and 12, respectively, at the terminal point of a fuel transfer tunnel 14 of a nuclear reactor facility. The tunnel 14 of FIG. 2 extends through a substrate 16 and terminates at a nuclear reactor containment pool boundary wall 18. The tunnel 14 terminates at its opposite end at a spent fuel storage pool boundary (not shown).

The door frame 12 comprises a cylindrical support wall 20 and an annular seat or flange 23. The wall 20 is concentric with and of a diameter greater than that of the tunnel 14, and is peripherally welded or otherwise secured to the wall 18. The seat 23 has outer and inner peripheral walls 24 and 25, respectively, and flat front and rear surfaces 26 and 28, respectively. The rear surface 28 of the seat 23 is welded to the support wall 20, with a plurality of gussets 29 extending between the surface 28 and the wall 20. The surfaces 26 and 28 are substantially parallel with respect to each other and with respect to the wall 18. It is essential that the respective welds between the wall 20, the wall 18 and the surface 28 provide positive sealing.

The seat front surface 26 has three concentric annular grooves 30, 31 and 32. The inner and outer grooves 30 and 32, respectively, each carry an annular elastomer compression seal 33, and are preferably dovetailed for retention of the seals. The central groove 31 is connected to an internal radial conduit 36 for in-service leak testing.

A pair of spaced apart hinge support arms 37 are fixed to and extend between the door frame 12 and the wall 18. A rotatable vertical hinge shaft 38 is rotatably mounted by extension through apertures (not shown) in each hinge support arm 37.

A pair of hinge arms 40 are fixed to and extend between the hinge shaft 38 and a front surface 42 of the door 10. The hinge shaft 38 extends upwardly to a handwheel 44 located above the surface of the reactor containment pool. Rotation of the handwheel 44 effects rotation of the door 10 about the axis defined by the hinge shaft 38. The door 10 has a generally flat rear surface 45 with an annular peripheral portion 46 engageable with the compression seals 33.

A plate 47 is rotatably secured to the center of the door front surface 42, as by a mounting bolt 48 and washers 50 and 52 disposed on either side of the plate 47. Four retention pins 54, 56, 58 and 60 extend from the door front surface 42 and are spaced at 90° intervals about and adjacent to the plate 47. Each of the pins 56, 58 and 60 carries a radially inwardly extending tab 62 which overlies the plate 47 to hold the plate in the event of fracture of the mounting bolt 48 and to limit rotation of the plate.

A plurality of door clamp asemblies, each generally designated 70, are secured to the periphery of the door front surface 42. While four clamp assemblies 70 are illustratively mounted at 90° intervals about the door periphery, it is to be understood that more or less than four clamp assemblies 70 may be utilized.

Each clamp assembly 70 includes two spaced apart side plates 72 upstanding from the door front surface 42. A pivot pin 74 extends between the plates 72 parallel to the door front surface 42. Referring to FIGS. 4–7, elongate slots 75 formed in the side plates 72 receive the pin 74 for rotation of the clamp 76 about an axis defined by the pin 74, and for limited travel of the clamp 76 normal to the front surface of the door.

Associated with each clamp 76 is a clamp wedge assembly, generally designated 80, including an arm 82 received by a pair of parallel radial links 84 and 85 and pivotally connected thereto by a pin 86. The links 84 and 85 receive and are pivotally connected to the disc 47 by a pin 88.

Figure 4:
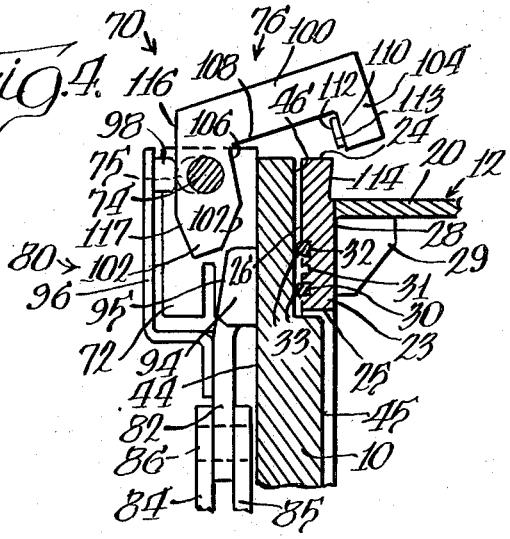
FIG. 4 is a section of a clamp assembly of the door securing mechanism of FIG. 3 taken approximately along line 4—4 of FIG. 3.

Briefly referring to FIG. 4, it can be seen that each arm 82 terminates in a wedge 94 having a cam surface 95. Each wedge extends between and is guided by the spaced plates 72. Secured to and extending radially from each arm 82 is an arm 96 overlying an associated clamp 76 and terminating in a cam block 98 spaced radially from its associated wedge 94 and at a greater distance from the front surface of the door.

The construction of a representative clamp 76 is best described with reference to FIGS. 4–7. Each clamp 76 is generally C-shaped and includes a base 100 terminating at its ends in forward and rear radial clamp legs 102 and 104. The clamp legs 102 and 104 have inner surfaces 106 and 107, and 110, respectively. The surface 106 is inclined from a surface 108 of the base 100 at an oblique angle and the surface 107 is inclined from the surface 106 at an oblique angle. The surface 110 of clamp leg 104 has a seat 112 with a surface 113 inclined at an acute angle with respect to the base surface 108 to mate with an inclined portion 114 of the seat rear surface 28.

The angle of inclination of the clamp leg surface 106 with respect to the door front surface 42 corresponds to the angle of inclination of the wedge surface 95 when the door 10 is closed and when the clamp base is parallel to the seat wall 24. The clamp leg 102 additionally has outer angularly related surfaces 116 and 117.

Referring again to FIG. 1, a pair of spaced arms 144 are fixed to and extend from the plate 47 generally parallel to the door surface 42. The arms 144 carry a cylindrical nut 146 which receives a threaded shaft 150. The cylindrical nut 146 is fixed against rotation about the axis defined by the shaft 150, but is free to pivot within openings in the arms 144 to maintain its alignment with the shaft 150, as described below.

The threaded shaft 150 is threaded into a pair of spaced nuts 152 and 154 positioned at either side of a shaft support block 156 which is in turn secured to the door surface 42. The threaded shaft 150 extends into a smooth oversize bore in the support block 156 and the nuts 152 and 154 locate the threaded shaft 150 axially relative to the support block 156 while permitting limited pivotal movement of the shaft relative to the block to accommodate arcuate movement of arms 144. The shaft 150 terminates at its upper end 158 in a yoke 160 adapted to receive a mating yoke 162 on the lower end of remote operating structure including an elongate shaft 164 terminating in handwheel 166 located above the surface of the reactor containment pool. The yoke 162 is removable from the yoke 160 by lifting of the shaft 164.

DESCRIPTION OF OPERATION

Figure 3:
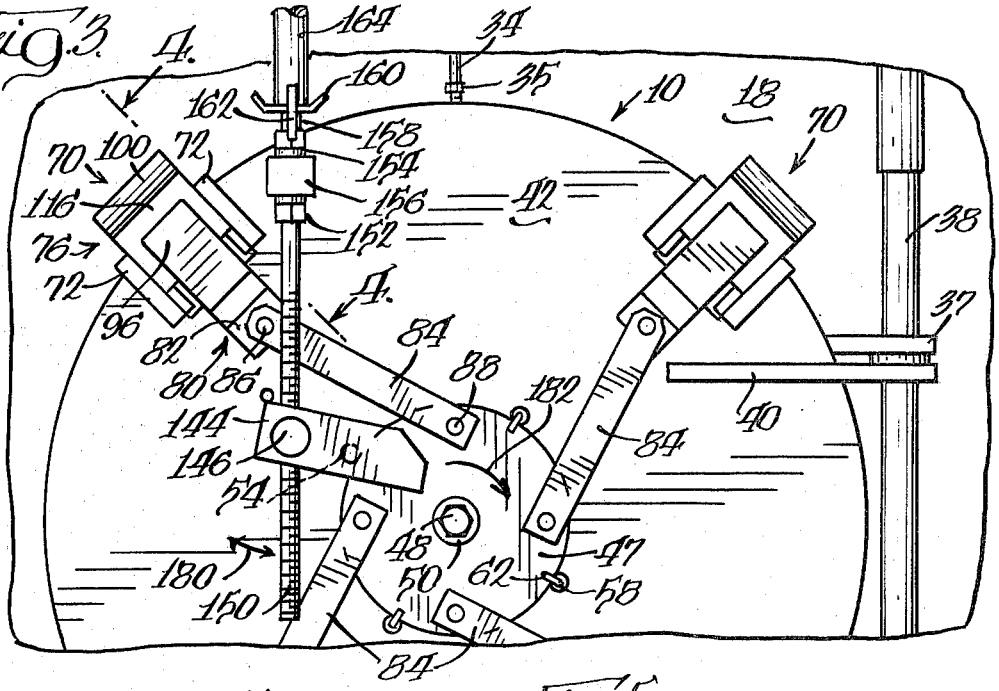
FIG. 3 is a fragmentary elevation of the door and frame of FIG. 1 with the door shown in its closed position and the door securing mechanism shown in its fully unlatched position.

The door 10 is selectively positioned in its closed position or in an open position by rotation of the handwheel 44 and the shaft 38. FIGS. 3 and 4 illustrate the door 10 in its closed but fully unlatched position wherein the wedge assemblies 80 are fully retracted and the clamp legs 104 are each positioned radially outwardly of the door 10 and frame 12, and the clamp pivot pins 74 are at one end of the slots 75. The cam block 98 engages the cam surface 116 of each clamp 76 to maintain each clamp 76 in the position of FIG. 4. This enables opening and closing of the door.

FIG. 3 illustrates the configuration of the door securing mechanism when the wedge assemblies 80 and the clamp assemblies 70 are in the positions shown in FIG. 4. The configuration of FIG. 3 is best described with comparative reference to FIG. 1 in which the door is in its closed and fully latched position. In FIG. 3, the arms 144 and the plate 47 have been rotated in a clockwise direction to angularly shift the pins 88 with respect to each associated wedge assembly 80 whereby each set of links 84 and 85 is shifted angularly and radially with respect to the clamp assemblies 70 to retract each associated wedge assembly 80, as described below.

Angular shifting of the arms 144 and the plate 47 is effected by rotation of the threaded shaft 150, which causes the cylindrical nut 146 to travel upwardly along the threaded shaft 150. During rotation of the threaded shaft 150, the shaft pivots about support 156, as indicated by the arrow 180, and the nut 146 and the arms 144 carried thereby travel in an arc centered at the bolt 48, as indicated by the arrow 182. The pins 56–60 and associated tabs 62, along with the pin 54, will retain the plate 47 substantially in its position should the mounting bolt 48 shear during rotation, to prevent failure of the respective wedge and clamp assemblies 80 and 70. The absence of a tab on the pin 54 allows the arms 144 to be rotated to the position shown in FIG. 3, wherein the arms 144 overlie the pin 54. Additionally, the pins 56–60 serve as stops against which the associated sets of links 84 and 85 abut when the configuration of FIG. 1 is reached.

Clockwise rotation of the plate 47 results in retraction of each arm 82 as a result of a pulling action of the links 84 and 85, until each wedge assembly 80 has reached its fully retracted position, shown in FIG. 4. As each wedge assembly 80 is retracted, its associated cam block 98 engages the associated cam surface 116 on a clamp to urge the clamp pivot pin 74 to an end of the slots 75 and rotate the clamp to the position of FIG. 4.

Figure 7:
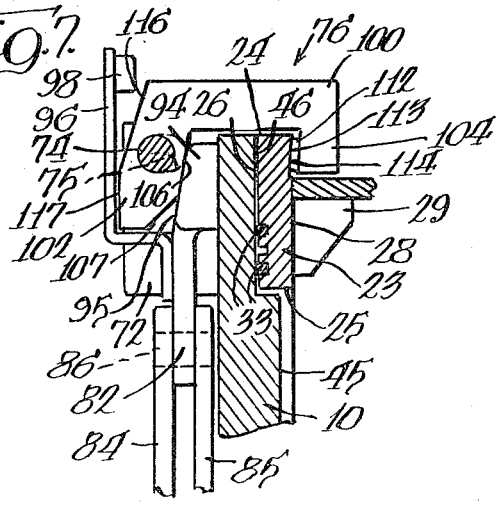
FIG. 7 is the clamp assembly of FIG. 4 shown fully latched.

To effect latching of the clamp 76 about the door 10 and frame 12, the wedge assemblies 80 are moved to their fully extended or advanced positions shown in FIGS. 1 and 7. Extension of the wedge assemblies 80 is effected by counterclockwise rotation of the shaft 150 to effect counterclockwise rotation of the arms 144 and the plate 47 to urge the wedge assemblies 80 radially outwardly through the successive positions shown in FIGS. 5, 6 and 7 by angular and radial shifting of the sets of links 84 and 85.

Figure 5:
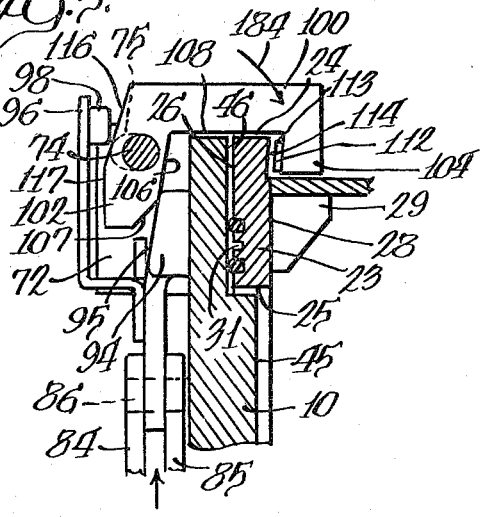
FIG. 5 is the clamp assembly of FIG. 4 shown in latching position.
Figure 6:
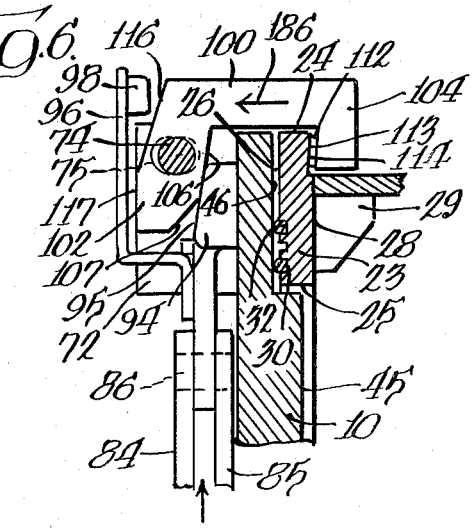
FIG. 6 is the clamp assembly of FIG. 4 shown partially latched.

As the wedges 94 are extended, each engages, in succession, the cam surfaces 106 and 107 to urge the clamp pivot pin 74 along the slots 75 and rotate the clamp leg 104 inwardly, as indicated by the arrow 184 in FIG. 5, disposing each clamp leg 104 behind the door frame flange and adjacent the frame surface 114. The cam surface 107 of the leg 102 is inclined so as to allow unobstructed extension of the wedge 94. As the outward extension of the wedge 94 is continued, the clamp leg 102 continues its travel in the direction of the arrow 186, FIG. 6, to cause the seat 112 thereon to tightly engage the inclined frame surface 114. The inclined configurations of the seat 112 and the surface 114 prevents radial dislocation of the seat 112 from the surface 114 by forces exerted against the door.

FIG. 7 shows the wedge 94 at its fullest extension. The clamp leg surface 117 of each clamp 76 is parallel to the overlying arms 96. In the position of FIG. 7, the rear door surface 45 is tightly engaged with the seals 33. Direct door-to-frame contact is not preferred, and the dimensions of the links 84 and 85, the wedge 94 and the clamp 76 are chosen to effect a desired seal load. Since direct door-to-frame contact is not preferred, minor distortion of the frame during installation is compensated for by the compression seals 33.

Retraction of the wedges 94 by clockwise rotation of the plate 47 retracts the cam blocks 98 for engagement with the cam surfaces 116 to urge each clamp leg 102 toward the door surface 42 and to rotate each clamp leg 104 radially outwardly from the door 10 and frame 12 to effect unlatching.

It is apparent that the door securing mechanism described above is readily accessible from a remote station and requires minimal actuation effort, yet provides a positive seal between two points, such as a reactor containment pool and a fuel transfer tunnel, which seal maintains its integrity over a wide range of seismic or other disturbances which may occur at a distance from the location of the mechanism, since only those disturbances acting directly on the elements of the mechanism will adversely affect the integrity of the seal.

We claim:

1. A door securing mechanism for latching a door to a door frame having an annular flange with compressive seal means comprising a plurality of generally C-shaped clamps having a pair of spaced apart generally parallel legs and an interconnecting base and carried by the door for movement between a retracted position and a latching position wherein a first one of the clamp legs of each clamp engages behind said annular flange and the second clamp leg of each clamp overlies a face of the door with the interconnecting base spanning said door and flange, and wedge means movable between the second clamp legs and the door face to exert a force in a direction to compress the door and frame together.

2. In combination with a door frame having an annular flange with front and rear surfaces and a door pivotally mounted to said frame for movement between a closed position and an open position, said door having front and rear surfaces, said door rear surface engaging seals carried by said frame front surface when said door is in its closed position, door securing means comprising:

a plurality of clamps, each said clamp including a base and first and second spaced apart legs projecting from said base and spaced apart sufficiently to capture said door and said door frame therebetween when said door is in its closed position, said first leg having inner and outer cam surfaces and a pin extending from opposite sides thereof in a direction parallel to said door front surface;

a pair of mounting plates associated with each said clamp and fixed to and upstanding from the periphery of said door front surface, each said mounting plate having an elongate slot to receive a respective end of said pin extending from said first clamp leg for rotation of said clamp about an axis defined by said pin and limited movement of a clamp normal to the door front surface, said clamp in retracted position having said first leg overlying said door front surface with said inner cam surface spaced from said door front surface and said second leg positioned to clear said annular flange as the door is moved to closed position;

a plurality of wedges, each said wedge being associated with one said clamp and slidably secured to said door front surface for movement radially of the door between extended and retracted position when the door is closed, each said wedge having a cam surface engageable with the inner cam surface of the first leg of its associated clamp as said wedge moves to its extended position to rotatably urge said clamp about said rotational axis and move said second leg behind said frame rear surface and thereafter shift the clamp in said normal direction to draw said second leg into tight engagement with said frame rear surface, each said wedge further having an arm spaced from said door front surface to overlie said first leg, said arm being located relative to said wedge for engagement with said first leg outer cam surface as said wedge is retracted to move said first leg toward said door front surface and to rotate said second leg outwardly away from said door frame; and means for moving said wedges radially of the door toward and away from said clamps.

3. In combination with a door frame having front and rear surfaces and a door pivotally mounted to said frame for movement between a closed position and open positions, said door having front and rear surfaces, said door rear surface engaging said frame front surface when said door is in its closed position, door securing means comprising:

a plurality of generally C-shaped clamps, each said clamp including first and second radial legs and a connecting section and said legs being apart to capture said door and said door frame when said door is in its closed position, said first radial leg having an inner cam surface;

means mounting each said clamp about the periphery of said door front surface for rotation about an axis parallel to said door front surface and for limited travel normal to said door front surface with said first radial leg overlying said door front surface with said inner cam surface spaced from said door front surface and said second radial leg being spaced from said door rear surface; and a plurality of wedges, each said wedge being associated with one said clamp and movably secured to said door front surface for movement radially of the door between extended and retracted positions, each said wedge having a cam surface engageable with the inner cam surface of the first radial leg of its associated clamp when said wedge moves toward its extended position rotatably urge said clamp about said rotational axis to rotatably urge said second radial leg behind said frame rear surface and thereafter cause said normal movement whereby said second radial leg is brought into tight engagement with said frame rear surface.

4. The door securing means of claim 3 wherein said clamp mounting means comprises a pin extending from opposite sides of said first radial leg parallel to said door front surface, and support means upstanding from said door front surface, said support means having an elongate slot extending in an axial direction with respect to said door front surface and receiving the respective ends of said pin for support of said pin and said clamp and enabling movement of said pin lengthwise of said slot.

5. The door securing means of claim 4 wherein said support means comprises a pair of upstanding plates fixed to said door front surface and positioned at opposite sides of said clamp.

6. The door securing means of claim 3 wherein said first radial leg has an outer cam surface opposite said inner cam surface and each said wedge has an arm spaced therefrom, said arm being engageable with said radial leg outer cam surface when said wedge is retracted to urge said second radial clamp leg away from said door frame and thereafter cause rotation of the clamp.

7. Door latching structure including a clamp and means for actuating said clamp to secure a door to a frame when said door is in a closed position, said door having front and rear surfaces and said frame having a flange with a front surface engageable with said rear door surface when said door is in said closed position, and a rear surface, said clamp being generally of a C shape to provide a pair of clamp legs and a connecting section of a length to span the thickness of said door and said door frame flange when said door is in its closed position;

means for mounting said clamp to said door front surface for rotation about an axis parallel to said door front surface and for limited travel in a direction normal to said door front surface with one clamp leg overlying said door front surface and having an inner cam surface spaced from said door front surface and the other of said legs spaced from said door rear surface;

a wedge associated with said clamp and mountable to said door front surface for movement radially of the door between extended and retracted positions, said wedge having a cam surface engageable with said clamp leg inner cam surface as said wedge moves to its extended position to axially and rotatably urge said clamp about said rotational axis to rotate said other leg behind said flange rear surface and thereafter cause said normal movement and bring the other clamp leg into tight engagement with said frame rear surface; and means for moving said wedge radially toward and away from said clamp.

8. The clamp of claim 7 wherein said one clamp leg has an outer cam surface opposite said inner cam surface and said wedge has an arm having a portion spaced from said wedge and said door front surface for engagement with said radial leg outer cam surface when said wedge is retracted to move said one clamp leg toward said door front surface and to rotate said other clamp leg away from said door frame.

9. The clamp of claim 7 wherein said clamp mounting means comprises a pin extending from opposite sides of said one clamp leg parallel to said door front surface, and support means comprising a pair of upstanding plates fixed to said door front surface, said plates each having an elongate slot extending in a direction normal to said door front surface and receiving the respective ends of said pin for floating support of said pin and said clamp.

10. The clamp of claim 7 wherein said flange and said other leg have coacting surfaces shaped at an angle to maintain the engagement therebetween as the wedge moves to its final extended position and exerts the total clamping force.

11. A door latching structure as defined in claim 7 wherein said means for moving said wedge radially includes link means pivotally connected thereto, a rotatable member mounted on said door for rotation about an axis and pivotally connected to said link means, a threaded actuator member rotatably mounted on said door, and a threaded follower on said actuator member and connected to said rotatable member whereby rotation of the threaded actuator member causes rotation of the rotatable member and radial movement of the wedge.

12. A door latching structure as defined in claim 11 wherein there are a plurality of said clamps each having a radially movable wedge, and each of said wedges have one of said link means pivotally connected thereto and to said rotatable member.

13. A door securing mechanism for latching a door to a door frame having an annular flange with compressive seal means comprising a plurality of clamps having a pair of spaced apart generally parallel legs and an interconnecting base and carried by the door for movement between a retracted position and a latching position wherein a first one of the clamp legs of each clamp engages behind said annular flange and the second clamp leg of each clamp overlies a face of the door with the interconnecting base spanning said door and flange, wedge means movable to an advanced position between the second clamp legs and the door face to exert a force in a direction to compress the door and frame together, and means operable as the wedge means moves from said advanced position for moving said clamps to said retracted position.

14. A door securing mechanism as defined in claim 13 wherein said wedge means includes a plurality of wedges associated one with each clamp, a plurality of links pivotally connected one to each wedge, a rotatable member mounted for rotation about an axis located centrally of said door with said links pivotally connected thereto and radiating therefrom, and remotely operable means carried by said door for rotating said rotatable member to cause movement of said wedges to and from said advanced position.

15. A door securing mechanism as defined in claim 14 wherein said remotely operable means includes a threaded shaft rotatably mounted on said door and having a yoke at one end for connection to a remote actuator, and means interconnecting said threaded shaft and rotatable member for converting rotation of said threaded shaft to rotation of said rotatable member.

* * * * *